United States Patent [19]

Miller

[11] 4,151,583

[45] Apr. 24, 1979

[54] FLASHLIGHT

[76] Inventor: Jack V. Miller, 700 N. Auburn Ave., Sierra Madre, Calif. 91024

[21] Appl. No.: 727,018

[22] Filed: Sep. 27, 1976

Related U.S. Application Data

[63] Continuation-in-part of Ser. No. 655,426, Feb. 5, 1976, abandoned.

[51] Int. Cl.[2] ..... F21L 9/00

[52] U.S. Cl. ..... 362/205

[58] Field of Search ..... 240/10.6, 10.6 R, 10.66, 240/10.68; 200/16 D, 60, 153 J, 159 R; 362/196, 202, 204, 205, 208

[56] References Cited

U.S. PATENT DOCUMENTS

| | | | |
|---|---|---|---|
| 1,195,728 | 8/1916 | Recker | 240/10.66 |
| 1,375,586 | 4/1921 | Graves | 200/60 |
| 2,229,486 | 1/1941 | Barash et al. | 362/205 |
| 2,277,633 | 3/1942 | Ceader | 240/10.66 |
| 2,309,402 | 1/1943 | Korngold | 200/60 |
| 2,530,913 | 11/1950 | Shackel | 240/10.6 R |
| 3,007,110 | 10/1961 | Rosenstrach | 362/205 X |
| 3,710,092 | 1/1973 | Olbermann, Jr. | 362/208 |
| 3,798,440 | 3/1974 | Brindley | 362/205 |
| 3,870,843 | 3/1975 | Witte | 362/189 X |
| 3,890,498 | 6/1975 | Toth, Sr. | 240/10.66 |
| 3,924,116 | 12/1975 | Brindley | 240/10.6 R |

*Primary Examiner*—J D Miller
*Assistant Examiner*—Peter S. Wong
*Attorney, Agent, or Firm*—Christie, Parker & Hale

[57] ABSTRACT

A flashlight has one or more batteries disposed in a first tubular housing section, a switch disposed in a second tubular housing section, and a lamp assembly with a light bulb disposed in a third tubular housing section. The first and second housing sections are joined by a threaded connection. The second and third housing sections are joined by a threaded connection, either directly or indirectly through a fourth tubular housing section in which one or more batteries are disposed. The switch has an elongated switch post supported to extend between two holes on opposite sides of the second housing section and to move axially toward one hole or the other without protruding substantially beyond the surface of the housing. An electrical circuit for the batteries and the bulb is opened and closed responsive to axial movement of the switch post. Diaphragms adjacent to the ends of the switch post seal the two holes. A baffle separating the lamp assembly from the batteries transfers axial inertial battery forces in the direction of the lamp assembly directly to the housing to isolate the bulb from such forces except as transferred through the housing, attenuating means, a bulb supporting reflector, and spring contacts

7 Claims, 9 Drawing Figures

15
14
12
11
10
57
50
40
38
44
73
72
70
69
68
71
60
74
54
43
78
80
83
86
87

FLASHLIGHT

CROSS REFERENCE TO COPENDING APPLICATIONS

This application is a continuation-in-part of application Ser. No. 655,426, filed Feb. 5, 1976, now abandoned.

BACKGROUND OF THE INVENTION

This invention relates to the lighting art and, more particularly, to an improved flashlight.

A number of flashlight users, such as policemen, firemen, and scuba divers, subject flashlights to heavy punishment, but demand reliable and lasting operation. Such users frequently employ a flashlight for purposes other than lighting, as for example a tool or a weapon, and expose flashlights to extremes in environmental conditions. When flashlights are jostled during use for other purposes, the axial inertial forces of the batteries in the direction of the lamp assembly may break the filament of the light bulb. Moisture entering the housing of the flashlight may corrode the contacts in the electrical circuit for the batteries and the light bulb. The switch for turning the flashlight on and off is particularly vulnerable to corrosion due to moisture or damage from external forces. Easy repair and replacement of parts in the field so a damaged flashlight may be returned to service quickly is a valuable attribute in demanding applications such as police work, fire fighting, and scuba diving.

SUMMARY OF THE INVENTION

According to the invention, a flashlight has a tubular housing comprising a front portion adapted to receive at least one battery, a back portion adapted to receive at least one battery, a middle portion disposed between the front and back portions, and a switch filling the middle portion to the exclusion of any batteries and forming a stationary barrier between the front and back portions of the housing. The switch separates and protects the batteries received by the front and back portions from each other when the flashlight is jostled. Preferably, the back portion of the housing is adapted to receive more batteries than the front portion thereof, and the front and back portions are so proportioned that the switch is disposed near the balance point of the flashlight. In one embodiment, the housing is modular, each portion having a threaded connection to the adjoining portion.

BRIEF DESCRIPTION OF THE DRAWINGS

The features of specific embodiments of the best mode contemplated of carrying out the invention are illustrated in the drawings, in which.

DETAILED DESCRIPTION OF THE SPECIFIC EMBODIMENTS

Figures 1, 2, 3, 4, 5, 6:
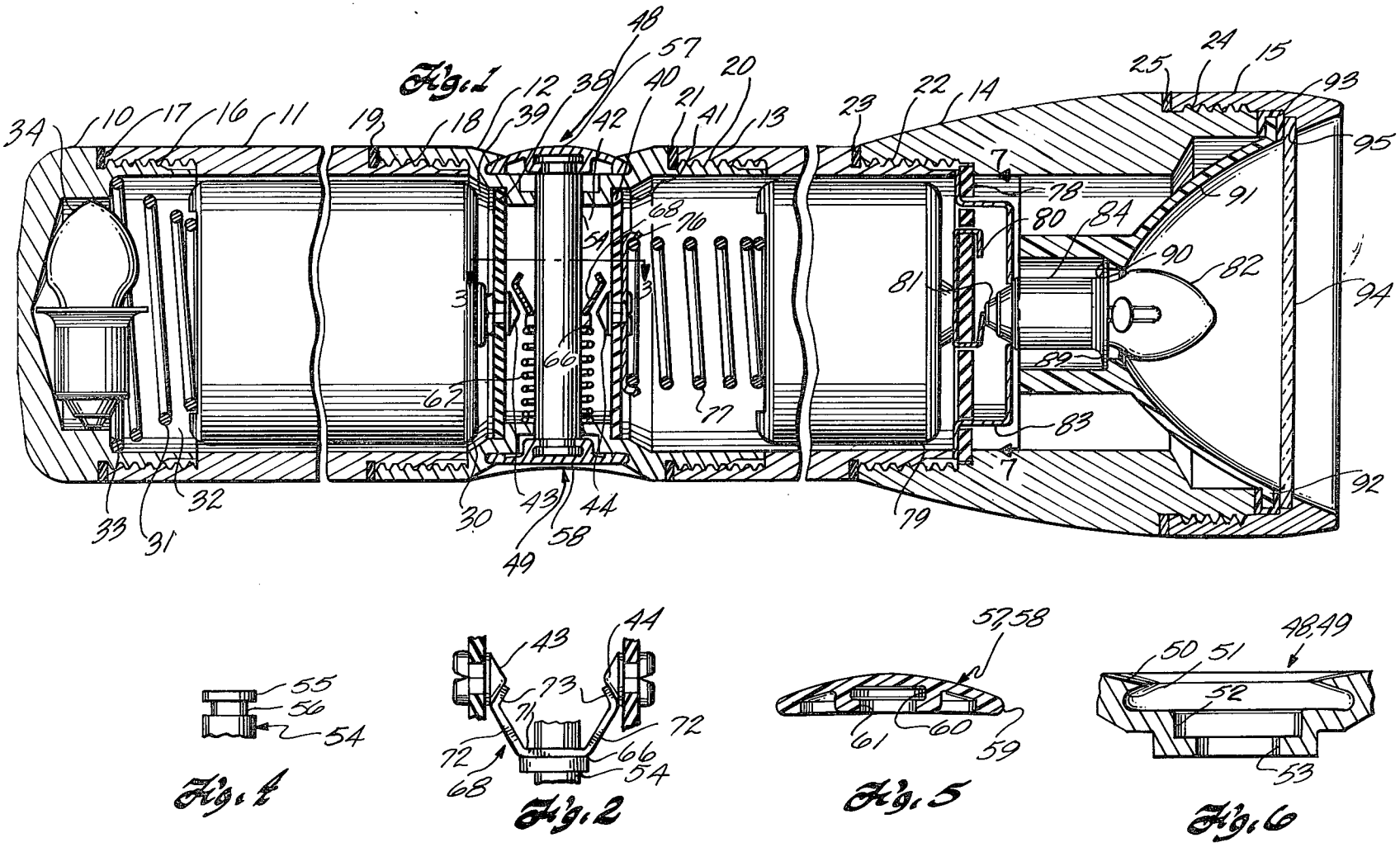
FIG. 1 is a side sectional view of a flashlight incorporating the principles of the invention.
FIG. 2 is a side sectional view of the switch contacts in FIG. 1 in the latched-closed position.
FIG. 3 is top sectional view of the switch of FIG. 1 through the plane 3—3 indicated in FIG. 1.
FIG. 4 is a side view of one end of the switch post shown in FIG. 1.
FIG. 5 is a side sectional view of one of the diaphragms shown in FIG. 1.
FIG. 6 is a side sectional view of one hole in the switch housing section shown in FIG. 1.

In FIG. 1 is shown a flashlight having an end cap 10, a tubular battery housing section 11 adapted to receive one or more batteries, a tubular switch housing section 12 in which a switch is disposed, a tubular battery housing section 13 adapted to receive one or more batteries, a tubular lamp assembly housing section 14, and a bezel 15. End cap 10 and housing section 11 are joined by a threaded connection 16 and sealed by an elastomeric washer 17. Housing sections 11 and 12 are joined by a threaded connection 18 and sealed by an elastomeric washer 19. Housing sections 12 and 13 are joined by a threaded connection 20 and sealed by an elastomeric washer 21. Housing sections 13 and 14 are joined by a threaded connection 22 and sealed by an elastomeric washer 23. Lamp assembly housing section 14 and bezel 15 are joined by a threaded connection 24 and sealed by an elastomeric washer 25. End cap 10 and housing sections 11, 12, and 13 are all made of an electrically conductive material such as aluminum. Threaded connections 16, 18, 20, 22, and 24 are all interchangeable. End cap 10, housing sections 11, 12, 13, and 14, and bezel 15 serve as a waterproof modular case for the flashlight.

One or more D-batteries 30 are disposed in housing section 11 in an end to end series arrangement. A compression spring 31 lies in a cavity 32 formed in end cap 10 and extends between an annular shoulder 33 in end cap 10 and the bottom end of battery 30 in contact with its negative terminal. Compression spring 31 is made of an electrically conductive spring alloy such as beryllium copper or phosphorus bronze. References to spring alloy material hereinafter could also be the same compositions. A spare light bulb 34 is stored in cavity 32 behind spring 31.

A disc-shaped partition or baffle 38 is bonded to an annular shoulder 39 formed in switch housing section 12 adjacent to battery housing section 11. Similarly, a disc-shaped partition or baffle 40 is bonded to an annular shoulder 41 formed in switch housing section 12 adjacent to battery housing section 13. Partitions 38 and 40 are made of an electrically insulative material and define a cylindrical switch cavity 42. A rivet 43 made of an electrically conductive material serves as a stationary switch contact extending through partition 38. A rivet 44 made of an electrically conductive material serves as another stationary switch contact extending through partition 40. Spring 31 urges the positive terminal of battery 30 against rivet 43. Holes 48 and 49 are formed on opposite sides of switch housing 12. As shown in FIG. 6, each of holes 48 and 49 has a truncated conical outer surface 50, an annular recess 51, a counterbore 52, and a bore 53. An enlongated switch post 54 extends between holes 48 and 49, passing through bores 53 with a close fit. Switch post 54 is substantially no longer than the distance between holes 48 and 49 and is made of an electrically insulative material. As illustrated in FIG. 1, the length of switch post 54 is such that one end thereof is located at the entrance of counterbore 52 when the other end thereof is at the base of conical surface 50. As shown in FIG. 4, at each end, switch post 54 has a head 55 and a neck 56. A pliable, disc-shaped diaphragm 57 covers hole 48, and a pliable disc-shaped diaphragm 58 covers hole 49. As shown in FIG. 5, diaphragms 57 and 58 each have an outer edge 59 that fits in recess 51 and is bonded thereto to form a watertight seal, a recess 60, and an entrance 61 of reduced diameter relative to recess 60. Head 55 at the ends of switch post 54 fits into recess 60 of diaphragms 57 and 58, where they are retained by entrance 61 and by bonding. Thus, diaphragms 57 and 58 remain adjacent to and in contact with the ends of switch post 54. Switch post 54 is supported for axial movement by the close fit with bores 53. Diaphragms 57 and 58 serve as stops on the axial movement of switch post 54 when one or the other of them abuts the annular shoulder counterbore 52 forms with bore 53, preventing protrusion of the ends of switch post 54 beyond the surface of the flashlight case. A flush switch results, i.e., a transverse force substantially flush with the surface of the case must be exerted in order to actuate the switch. A generally rectangular-shaped spring contact 68 made of electrically conductive spring alloy is secured to switch post 54 by means described below. An annular insulating ring 66 is disposed on switch post 54, and a compression spring 67 on switch post 54 extends between insulating ring 66 and the inner surface of switch housing section 12, to provide a spring bias for switch post 54 without shorting spring contact 68 to housing section 12.

As shown in FIGS. 2 and 3, spring contact 68 has a flat base portion 71, divergent intermediate portions 72 extending at one obtuse angle from each side of base portion 71, and convergent edge portions 73 extending at an obtuse angle from each intermediate portion 72. Base 71 has a cutout comprising a semicircular retaining portion 69 and an hourglass-shaped entry portion 74 extending from retaining portion 69 to the edge of base 71. Entry portion 74 is dimensioned to permit switch post 54 to pass through it to retaining portion 69, which engages a groove 70 formed in switch post 54. Entry portion 74, retaining portion 69, and groove 70 removably secure spring contact 68 to switch post 54. Spring 67 urges switch post 54 toward diaphragm 57 until stopped by diaphragm 58, as illustated in FIG. 1. When the switch is off, it can be turned momentarily on by depressing diaphragm 57 until intermediate portions 72 of spring contact 68 bear against rivets 43 and 44 to establish an electrical connection between rivets 43 and 44 through spring contact 68. When diaphragm 57 is then released, spring 67 returns the switch to the off position, illustrated in FIG. 1. When the switch is off, it can be latched in the on position illustrated in FIG. 2 by depressing diaphragm 57 beyond the momentary-on position until intermediate portions 72 are wedged together sufficiently to pass the tips of rivets 43 and 44, at which time edge portions 73 bear against rivets 43 and 44 to establish an electrical connection between rivets 43 and 44 through spring contact 68. Spring 67 urges edge portions 73 against rivets 43 and 44 in the latched-on position with sufficient force to establish a reliable electrical connection, but with an insufficient force to return the switch to the off position. When the switch in the latched on position is to be returned to the off position, diaphragm 58 is depressed until edge portions 73 are wedged together sufficiently to pass the tips of rivets 43 and 44 again, at which time spring 67 urges spring contact 68 away from rivets 43 and 44 into the off position illustrated in FIG. 1. As depicted in FIGS. 1 and 2, portions 72 and 73 of spring contact 68 each form an angle with the longitudinal axis of the flashlight approximately equal to the half angle of the conical shape of rivets 43 and 44, respectively. Thus, when the switch is open and diaphragm 57 is depressed to move intermediate portion 72 against rivets 43 and 44, a long line contact is formed. This high unit force contact results in a wiping action of the electrical contacts, which tends to maintain reliable switch operation. When intermediate portions 72 bear against rivets 43 and 44, they are deformed, thereby exerting a spring force on rivets 43 and 44 and providing better electrical contact. Similarly, when the switch is latched on and edge portions 73 bear against rivets 43 and 44, as shown in FIG. 2, a wiping switch action occurs as the switch is opened. While the switch remains in the latched on position, spring 68 urges end portions 73 against rivets 43 and 44 to deform them slightly. As a result, both spring 67 and edge portions 73 exert a force against rivets 43 and 44, thereby providing better electrical contact.

Figures 3, 7, 8, 9:
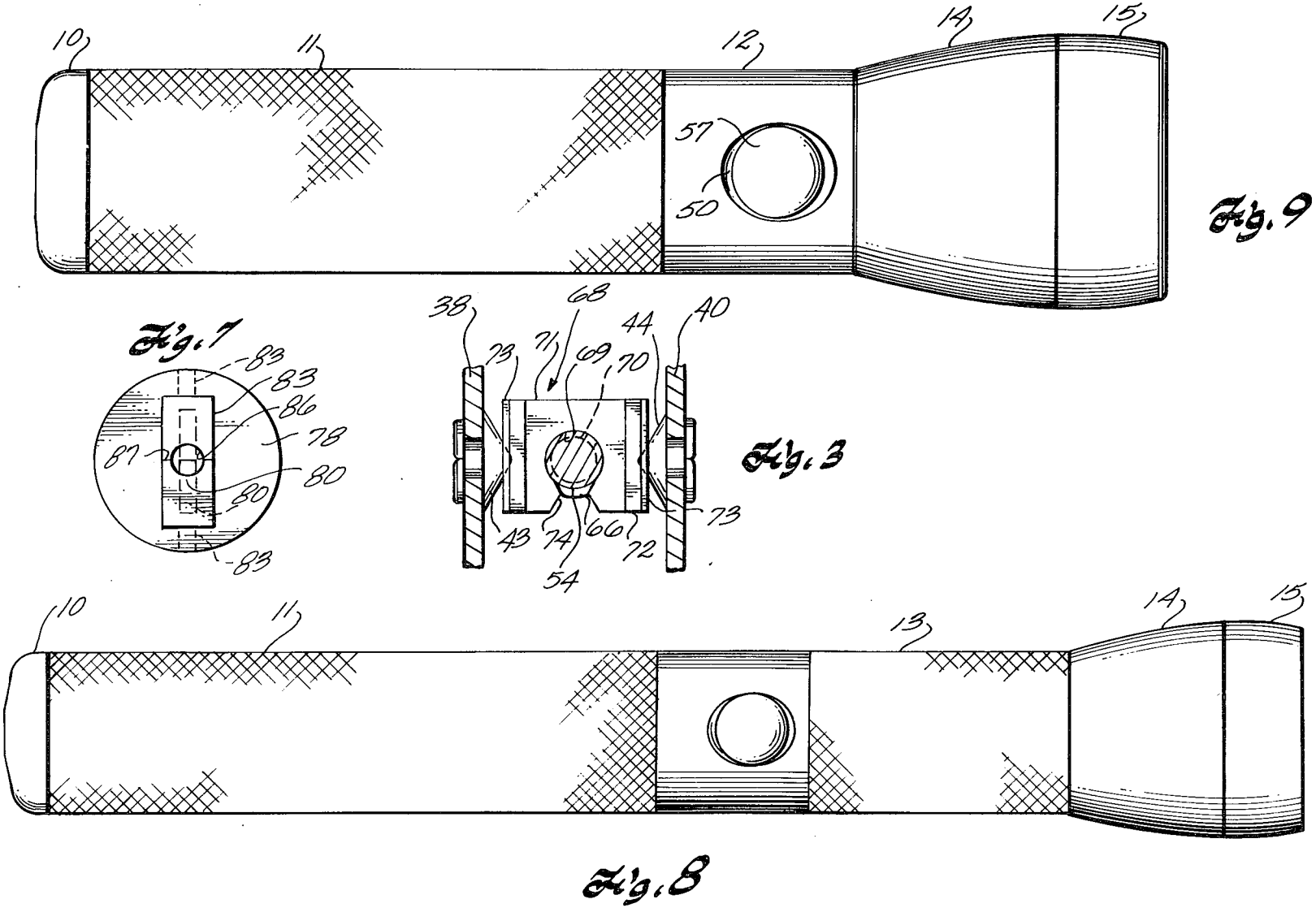
FIG. 7 is a front sectional view of the light bulb spring contacts through the plane 7—7 indicated in FIG. 1.
FIG. 8 is a top plan view of the flashlight of FIG. 1.
FIG. 9 is a top plan view of a modified embodiment of the flashlight of FIG. 1.

A spring keeper 76 made of an electrically conductive material abuts the surface of partition 40 facing toward housing section 13, where it is retained by rivet 44. A disc-shaped baffle or partition 78 made of an electrically isolative material is removably clamped between housing sections 13 and 14. One or more batteries 79 are disposed in housing section 13 in end to end series arrangement. A compression spring 77 made of an electrically conductive material urges battery 79 in a forward direction to place its positive terminal in contact with a resilient spring contact 80. Spring contact 80 is a bent strip of electrically conductive spring alloy that extends from the side of partition 78 facing housing section 13 to the side of partition 78 facing housing section 14, where one end of contact 80 abuts and is slightly deformed by a center terminal 81 of a conventional flashlight type light bulb 82. A resilient spring contact 83 is a bent strip of electrically conductive spring alloy that extends from the side of partition 78 facing housing section 13 in contact with the end of housing section 13 to the side of partition 78 facing housing section 14 where a hole 86 (FIG. 7) is formed in spring contact 83. The end of bulb 82 passes through hole 86 and a base shell terminal 84 of bulb 82 contacts spring contact 83 along the perimeter of hole 86. Spring contact 83 has a surface around hole 86 protruding toward bulb 82 to form a crease 87 (FIG. 7). Terminal 84 bears against spring contact 83, flattens it, and eliminates crease 87. As a result, spring contact 83 is slightly deformed. Bulb 82 has a flange 89 that is urged by spring contacts 80 and 83 against a shoulder 90 of a reflector 91, such that the filament of bulb 82 lies approximately at the focus of reflector 91. Reflector 91 has an outer flange 92 that is covered by an annular elastomeric sealing ring 93 with a U-shaped cross section. A transparent disc-shaped window 94 covers reflector 91. Window 94, sealing ring 93, and outer flange 92 are forced against the end of housing section 14 by an annular groove 95 on bezel 15 to seal the interface between window 94 and bezel 15.

When the switch is on, batteries 30 and 79 energize bulb 82 by means of the following electric circuit: the positive terminal of battery 30 is connected to the negative terminal of battery 79 through rivet 43, spring contact 68, rivet 44, spring keeper 76, and spring 77; the positive terminal of battery 79 is connected to terminal 81 of light bulb 82 by spring contact 80; the negative terminal of battery 30 is connected to terminal 84 of light bulb 82 through spring 31 and the portion of the flashlight case comprising end cap 10 and housing sections 11, 12, and 13, and spring contact 83. When the switch is off, as illustrated in FIG. 1, the electrical connection between batteries 30 and 79 through spring contact 68 is broken, the described electric circuit opens, and bulb 82 is deenergized.

In summary, the described flashlight is waterproof up to a depth of several hundred feet of water as a result of the seals provided by washers 17, 19, 21, 23, and 25, diaphragms 57 and 58, and sealing ring 93. Since the switch is contained completely within the flashlight case, it is also waterproof and, therefore, protected from corrosion and damage. The switch remains substantially flush with the surface of the flashlight case. Thus, it is not likely to turn on accidently when the flashlight case is bumped or jarred. The switch itself is balanced when subjected to high ambient pressure such as in underwater applications, because external pressure is exerted equally on both ends of switch post 54 through diaphragms 57 and 58. The surfaces of spring contact 68 are subjected to a wiping action as the switch turns on and off to provide a better electrical contact. The switch can be turned momentarily on or latched on.

Housing sections 11 and 13 serve as a battery chamber, housing section 14 serves as a light bulb chamber, partitions 38 and 40 serve to separate portions of the battery chamber, and partition 78 serves to separate the light bulb chamber from the battery chamber. When the flashlight is jostled, large axial inertial forces result from movement of batteries 79 in the direction of partition 78, i.e., toward the front of the flashlight. These axial inertial battery forces are transferred directly to the case of the flashlight by partition 78, and are transferred to bulb 82 only through the case, spring contacts 80 and 83, sealing ring 93, and reflector 91. In other words, bulb 82 is isolated from such forces except as transferred through the flashlight case, spring contacts 80 and 83, sealing ring 93, and reflector 91. Spring contacts 80 and 83 and sealing ring 93, because they are resilient, substantially attenuate the axial inertial battery forces.

Similarly, partition 38 transfers axial inertial forces resulting from movement of batteries 30 directly to the flashlight case.

The modular construction of the flashlight of FIG. 1 permits easy repair of a faulty electrical circuit in the flashlight. For example, an inoperative switch can be repaired simply by unscrewing housing section 12 having the faulty switch from housing sections 11 and 13 and replacing it, as a unit, with a new housing section 12 having an operative switch. Similarly, a faulty spring contact to the light bulb terminals, i.e., spring contact 80 or 83, can be repaired by unscrewing housing sections 13 and 14 and replacing partition 78 and spring contacts 80 and 83 as a unit.

The modular construction of the flashlight also permits the switch to be located at or near the balance point of the flashlight irrespective of the number of batteries. The switch is located at or near the balance point as that term is used herein, if the thumb of the flashlight user is on the switch, i.e., on diaphragm 57, when the user's hand grips the flashlight case approximately at its center of gravity.

In FIG. 8, a flashlight comprising the components of FIG. 1 is provided with four batteries; housing section 11 is adapted to receive one battery, housing section 13 is adapted to receive three batteries, and housing section 12 is disposed between housing sections 11 and 13 to provide a switch at or near the balance point. In a five battery embodiment, three batteries are disposed in housing section 11 and two batteries are disposed in housing section 13. In a six battery embodiment, four batteries are disposed in housing section 11 and two batteries are disposed in housing section 13. In a seven battery embodiment, four batteries are disposed in housing section 11 and three batteries are disposed in housing section 13.

In FIG. 9, a flashlight comprising the components of FIG. 1, except for housing section 13, has two batteries both located in housing section 11. Housing section 12 is joined directly to housing section 14 to locate the switch at or near the balance point, because the center of gravity of the flashlight is closer to housing section 14 than in FIG. 8. With section 12 threaded directly into section 14, the electrical circuit is completed by spring 77 being in direct contact with spring contact 80.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention. For example, the various features of the invention including modularity, flush switching, and transfer of axial inertial battery forces directly to the housing may be practiced individually. In a modular flashlight according to the invention, more or fewer housing sections than actually shown may be employed; thus, the recitation of a "housing section" in the claims reads on either one housing section or a plurality of housing sections joined by threaded connections. For example, the recitation of a "lamp assembly housing section" reads on housing section 14 alone or housing sections 13 and 14 together. The flush switch could have a different form of spring contacts than disclosed, or in some applications not requiring a waterproof flashlight, the diaphragms could be eliminated. Other means than those specifically disclosed could be employed to isolate the light bulb from axial inertial battery forces in accordance with the principles of the invention.

What is claimed is:

1. A flashlight having a tubular housing with a back end, a front end, a first portion adjacent to the back end and adapted to receive at least one battery, and a second portion adjacent to the front end and adapted to receive at least one battery; a lamp assembly adapted to receive a light bulb; means for connecting the lamp assembly to the front end of the housing; means for closing the back end of the housing; and an electrical circuit including an ON-OFF switch between opposite terminals of the batteries received by the first and second portions of the housing and opposite terminals of a light bulb received by the lamp assembly, wherein the improvement comprises:

a third portion of the housing disposed between the first and second portions, the switch filling the third portion of the housing to the exclusion of any batteries and forming a stationary barrier between the first and second portions of the housing to separate and protect batteries received by the first portion of the housing from batteries received by the second portion of the housing.

2. The flashlight of claim 1, in which the first portion of the housing is adapted to receive more batteries than the second portion of the housing.

3. The flashlight of claim 1, in which the portions of the housing are so proportioned that the switch is disposed near the balance point of the flashlight.

4. The flashlight of claim 1, in which the first, second, and third portions of the housing are separate housing sections, the flashlight additionally comprising a first threaded connection between the first and third portions, and a second threaded connection between the second and third portions.

5. The flashlight of claim 4, in which the means for connecting the lamp assembly to the front end of the housing comprises a third threaded connection between the second portion and the lamp assembly.

6. The flashlight of claim 5, in which the means for closing the back end of the housing comprises an end cap and a fourth threaded connection between the end cap and the first portion.

7. The flashlight of claim 6, in which the first, second, third, and fourth threaded connections are interchangeable and washers are provided between the first, second, third, and fourth threaded connections to seal them.

* * * * *